US008974101B2

(12) United States Patent
Koizumi

(10) Patent No.: US 8,974,101 B2
(45) Date of Patent: Mar. 10, 2015

(54) VEHICULAR LAMP

(75) Inventor: Hiroya Koizumi, Shizuoka (JP)

(73) Assignee: Koito Manufacturing Co., Ltd., Minato-Ku (JP)

( * ) Notice: Subject to any disclaimer, the term of this patent is extended or adjusted under 35 U.S.C. 154(b) by 309 days.

(21) Appl. No.: 13/546,855

(22) Filed: Jul. 11, 2012

(65) Prior Publication Data

US 2013/0021815 A1 Jan. 24, 2013

(30) Foreign Application Priority Data

Jul. 20, 2011 (JP) ..... 2011-159414

(51) Int. Cl.
*F21V 5/00* (2006.01)
*F21S 8/10* (2006.01)

(52) U.S. Cl.
CPC ..... *F21S 48/215* (2013.01); *F21S 48/2212* (2013.01); *F21S 48/2243* (2013.01); *F21S 48/2262* (2013.01); *F21S 48/2281* (2013.01)
USPC ..... 362/522

(58) Field of Classification Search
CPC ..... F21S 48/2225; F21S 48/12; F21S 48/22; F21S 48/2237; F21S 48/2268; F21S 8/10
USPC ..... 362/520–522
See application file for complete search history.

(56) References Cited

U.S. PATENT DOCUMENTS

| | | | | |
|---|---|---|---|---|
| 6,273,591 | B1 * | 8/2001 | Albou | 362/520 |
| 7,686,481 | B1 * | 3/2010 | Condon et al. | 362/521 |
| 2004/0218400 | A1 * | 11/2004 | Egashira | 362/520 |
| 2007/0029563 | A1 | 2/2007 | Amano et al. | |

FOREIGN PATENT DOCUMENTS

| | | | |
|---|---|---|---|
| CN | 2585273 | Y | 11/2003 |
| JP | H6-349306 | | 12/1994 |
| JP | 2005-123092 | | 5/2005 |
| JP | 2007-280689 | A | 10/2007 |
| JP | 2008-277071 | | 11/2008 |

* cited by examiner

*Primary Examiner* — William Carter
(74) *Attorney, Agent, or Firm* — DLA Piper LLP (US)

(57) ABSTRACT

A vehicular lamp including a lens member between a light-emitting element (22) and a light guiding plate (26) in which emitted light from the light-emitting element (22) is incident on the rear end surface (26*a*) and then emitted from the front end surface (26*b*) to the front of the lamp. The lens member (28) allows a part of the emitted light, which travels in a direction close to an optical axis (Ax), to reach the light guiding plate (26) as diffusing light that diffuses in a horizontal plane and further allows the emitted light to reach the light guiding plate (26) as parallel light along the optical axis (Ax) in a vertical plane.

8 Claims, 9 Drawing Sheets

110

VEHICULAR LAMP

BACKGROUND OF THE INVENTION

1. Field of the Invention

The present invention relates to a vehicular lamp including a light guiding plate.

2. Description of the Related Art

One of the conventionally known vehicular lamp is constructed so that emitted light from the light-emitting element such as a light-emitting diode is incident on the rear end surface of a light guiding plate and then is emitted from the front end surface of the light guiding plate to the front of the lamp.

Japanese Patent Application' Laid-Open (Kokai) No. 2007-280689, for example, describes a lens component formed on the tear end surface of a light guiding plate provided along a horizontal plane in such a vehicular lamp. In this vehicular lamp, the lens component allows emitted light from the light-emitting element to be incident on the light guiding plate as converging light that converges in the forward direction of the light-emitting element.

The configuration described in Japanese Patent Application Laid-Open (Kokai) No. 2007-280689 increases the amount of light that is guided in a direction toward the forward direction of the light-emitting element inside the light guiding plate, and thus allows the light guiding plate to appear to be brightly lit when the light guiding plate is observed from the front of the lamp.

However, in the light distribution of the emitted light from the light-emitting element, the light traveling in the forward direction of the light-emitting element typically has the highest intensity. Accordingly, adopting the configuration described in Japanese Patent Application Laid-Open (Kokai) No. 2007-280689 causes such a problem that when the light guiding Plate is observed from the front of the lamp, only a portion close to the light-emitting element appears extremely brightly lit, and as a result, the light guiding plate cannot be made to appear to be lit in a substantially uniform manner due to this so-called point lighting phenomenon.

BRIEF SUMMARY OF THE INVENTION

The present invention was developed in view of the above problem, and it is an object of the present invention to provide a vehicular lamp that includes a light guiding plate and that allows the light guiding plate to appear brightly lit in a substantially uniform manner.

The present invention achieves the above object with a configuration that a predetermined lens member is provided between a light-emitting element and a light guiding plate.

More specifically, above-described object is accomplished by a unique structure of the present invention for a vehicular lamp that includes: a light-emitting element and a light guiding plate provided such that emitted light from the light-emitting element is incident on the rear end surface of the light guiding plate and then is emitted from the front end surface of the light guiding plate to the front of the lamp, and the vehicular lamp of the present invention further includes a lens member that is provided between the light-emitting element and the light guiding plate, and this lens member allows a part of the emitted light from the light-emitting element, which travels in a direction close to the forward direction of the light-emitting element, to reach the light guiding plate as diffusing light that diffuses in a first plane that is along the light guiding plate, and further to allow the emitted light from the light-emitting element to reach the light guiding plate as converging light that converges in the forward direction of the light-emitting element in a second plane that is orthogonal to the first plane.

The "light-emitting element" means a light source that is an element having a light-emitting portion that surface-emits light generally in the shape of a spot, and the type of the light-emitting element is not particularly limited.

The specific, shape of the "light guiding plate" is not specifically limited as long as the light guiding plate is constructed so that the emitted light from the light-emitting element is incident on the rear end surface of the light guiding plate, and then is emitted from the front end surface of the light guiding plate to the front of the lamp.

The "first plane" is any one of a horizontal plane, a vertical plane, and an inclined plane.

The specific shape of the "lens member" is not particularly limited as long as the lens member allows a part of the emitted light from the light-emitting element, which travels in the direction close to the forward direction of the light-emitting element, to reach the light guiding plate as diffusing light that diffuses in the first plane and further allows the emitted light from the light-emitting element to reach the light guiding plate as converging light that converges in the forward direction of the light-emitting element in the second plane. The above phrase "converging light that converges in the forward direction of the light-emitting element" refers to the light that is deflected in the direction toward the forward direction of the light-emitting element with respect to the direction of the light that reaches the light guiding plate if there is no lens member, and it is not necessarily the light that travels in the direction parallel to the forward direction of the light-emitting element.

As seen from the above in the vehicular lamp according to the present invention the emitted light from the light-emitting element is incident on the rear end surface of the light guiding plate and then is emitted from the front end surface of the light guiding plate to the front of the lamp, and in this construction, a lens member is provided between the light-emitting element and the light guiding plate, and this lens member allows part of the emitted light from the light-emitting element, which travels in the direction close to the forward direction of the light-emitting element, to reach the light guiding plate as diffusing light that diffuses in the first plane that is along the light guiding plate and further allows the emitted light from the light-emitting element to reach the light guiding plate as converging light that converges in the forward direction of the light-emitting element in the second plane that is orthogonal to the first plane. Accordingly, the vehicular lamp according to the present invention provides the effects described below.

In the vehicular lamp according to the present invention, the lens member allows a part of the emitted light from the light-emitting element, which travels in the direction close to the forward direction of the light-emitting element, to reach the light guiding plate as diffusing light that diffuses in the first plane that is along the light guiding plate. This can prevent the light that reaches the light guiding plate from having such an intensity distribution that the light intensity becomes extremely high in the forward direction of the light-emitting element in the first plane, and as a result, the light guiding plate can appear to be lit in a substantially uniform manner in a direction along the first plane when the light guiding plate is observed from the front of the lamp.

Moreover, in the vehicular lamp according to the present invention, the lens member allows the emitted light from the light-emitting element to reach the light guiding plate as converging light that converges in the forward direction of the light-emitting element in the second plane. Accordingly, the emitted light from the light-emitting element can be efficiently incident on the light guiding plate, and the light guiding plate can appear to be brightly lit when the light guiding plate is observed from the front of the lamp.

As seen from the above, according to the present invention, the light guiding plate provided in a vehicular lamp appears to be brightly lit in a substantially uniform manner, thus improving the appearance of the lamp.

In the above configuration, the lens member can be constructed so that it allows the emitted light from the light-emitting element to reach the light guiding plate in a luminance distribution that a pair of peak values of luminance appear on both sides of the forward direction of the light-emitting element in the first plane. As a result, the light that reaches the light guiding plate has a more uniform light intensity distribution in the first plane, and thus the light guiding plate can appear to be more uniformly lit in the direction along the first plane when the light guiding plate is observed from the front of the lamp.

In the present invention, the rear end surface of the light guiding plate can be formed with a lens component so that the lens component allows the emitted light from the light-emitting element, which has reached the light guiding plate through the lens member, to be incident on the light guiding plate as converging light that converges in the first plane. With this structure, it is easily possible to have the light guiding plate appear to be brightly lit in a substantially uniform manner in the direction along the first plane when the light guiding plate is observed from the front of the lamp.

When the front end surface of the light guiding plate is formed to extend to a large extent toward a rear side of the lamp from one end to the other end in the first plane, the emitted light from the light guiding plate cannot be emitted as diffusing light that diffuses in a balanced manner to both sides with respect to the forward direction of the lamp, if a plurality of lens elements are continuously formed on the front end surface of the light guiding plate along the wrap-around shape of the front end surface of the light guiding plate. In order to emit the light from the light guiding plate as diffusing light that diffuses in a balanced manner to both sides with respect to the forward direction of the lamp, the plurality of lens elements need to be formed to face the forward direction of the lamp, with a large step between the lens elements. However, this degrades the appearance of the light guiding plate.

Accordingly, when the front end surface of the light guiding plate is formed to extend to a large extent toward the rear side of the lamp from the one end to the other end in the first plane, the rear end surface of the light guiding plate can be formed to face a direction inclined toward the other end with respect to the forward direction of the lamp. This allows the emitted light from the light guiding plate to be emitted as diffusing light that diffuses in a balanced manner to both sides with respect to the forward direction of the lamp, even if the plurality of lens elements are continuously formed along the wrap-around shape of the front end surface of the light guiding plate, thus preventing degradation in appearance of the light guiding plate.

In the present invention, the light-emitting element can be provided at a plurality of positions in the first plane, each of the lens member and the light guiding plate can be provided at a plurality of positions corresponding to the plurality of light-emitting elements, the plurality of lens members can be coupled together to form a single lens member unit, and the plurality of light guiding plates can be coupled together to form a single light guiding plate unit. With this structure, the light guiding plates provided at the plurality of positions can appear to be brightly lit in a substantially uniform manner in the direction along the first plane when the light guiding plate unit is observed from the front of the lamp, and this can be implemented with a smaller number of parts.

DETAILED DESCRIPTION OF THE INVENTION

Hereinafter, an embodiment according to the present invention will be described in detail with reference to the accompanying drawings.

Figure 1:
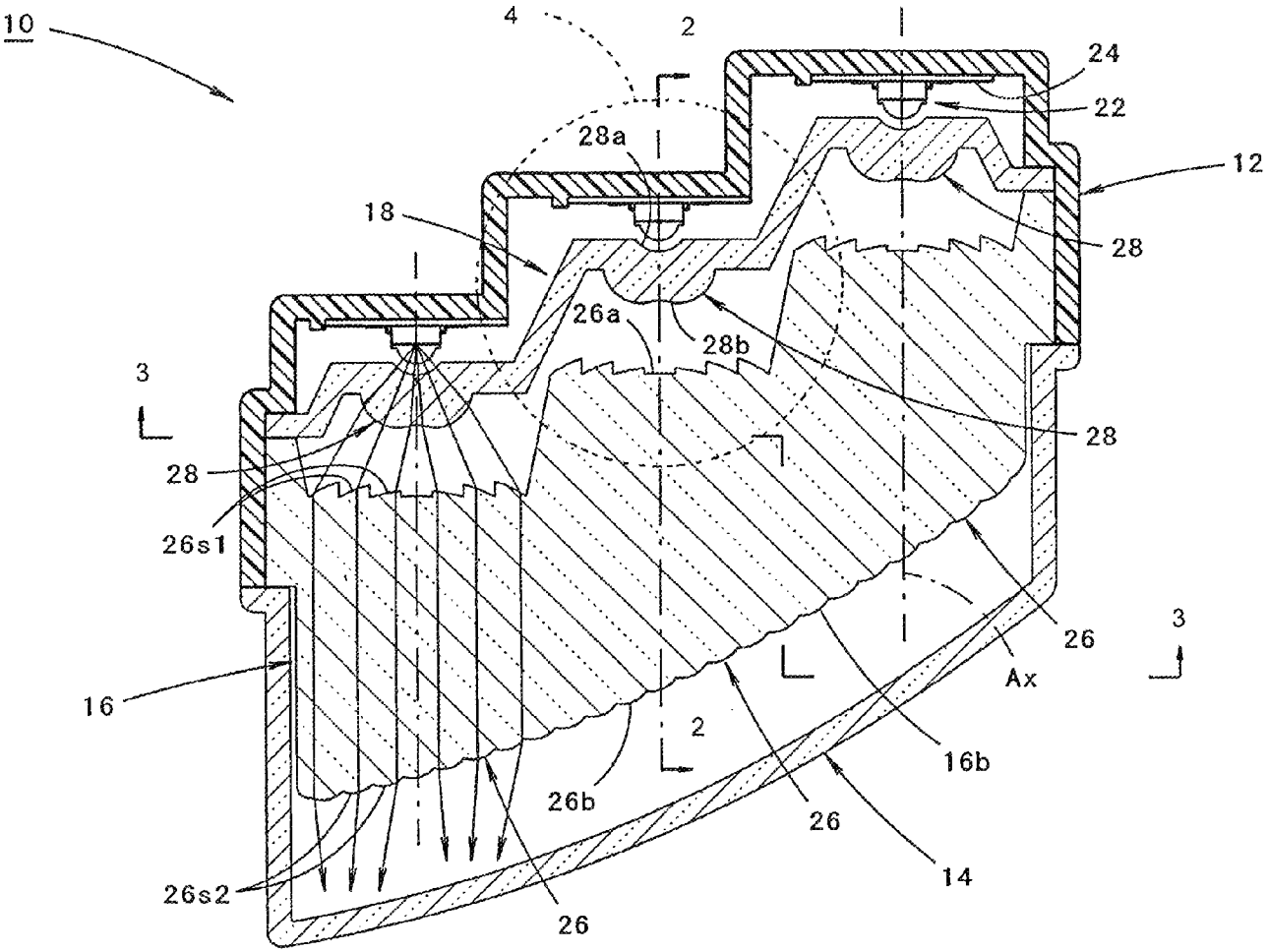
FIG. 1 is a horizontally cross-sectional view of a vehicular lamp according to an embodiment of the present invention.
Figure 2:
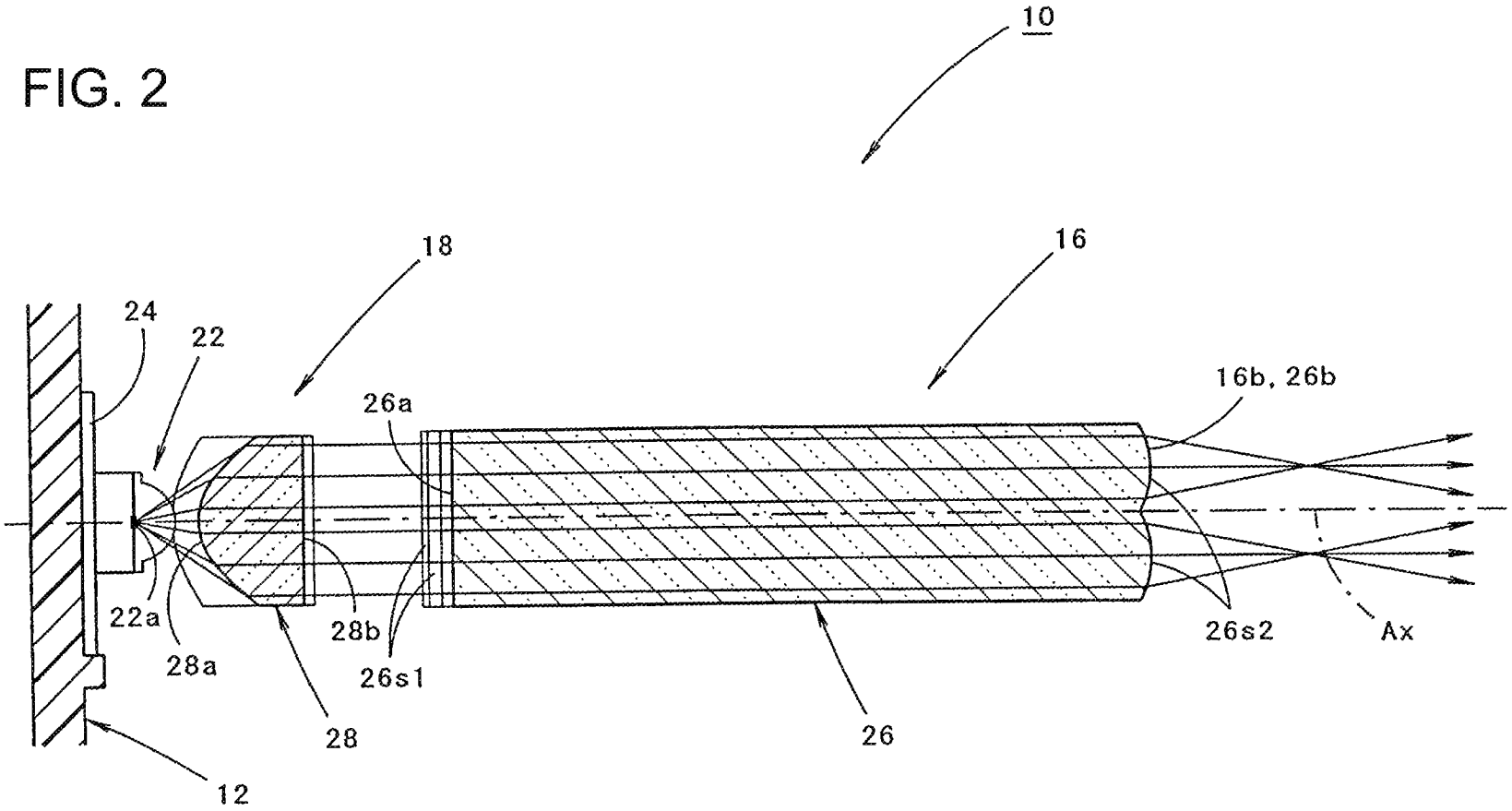
FIG. 2 is a cross-sectional view taken along the line II-II in FIG. 1.
Figure 3:
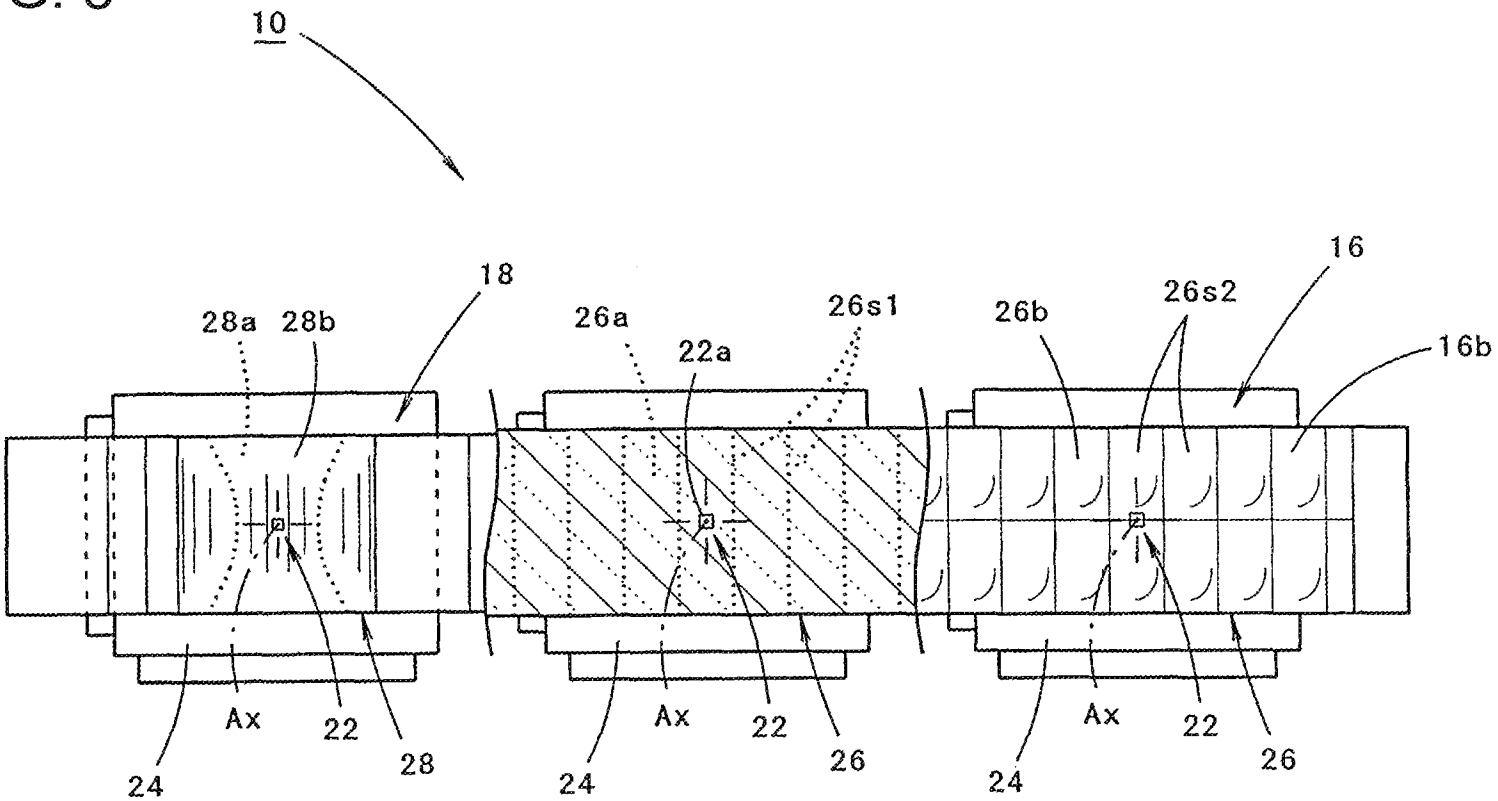
FIG. 3 is a cross-sectional view taken along the line III-III in FIG. 1.
Figure 4:
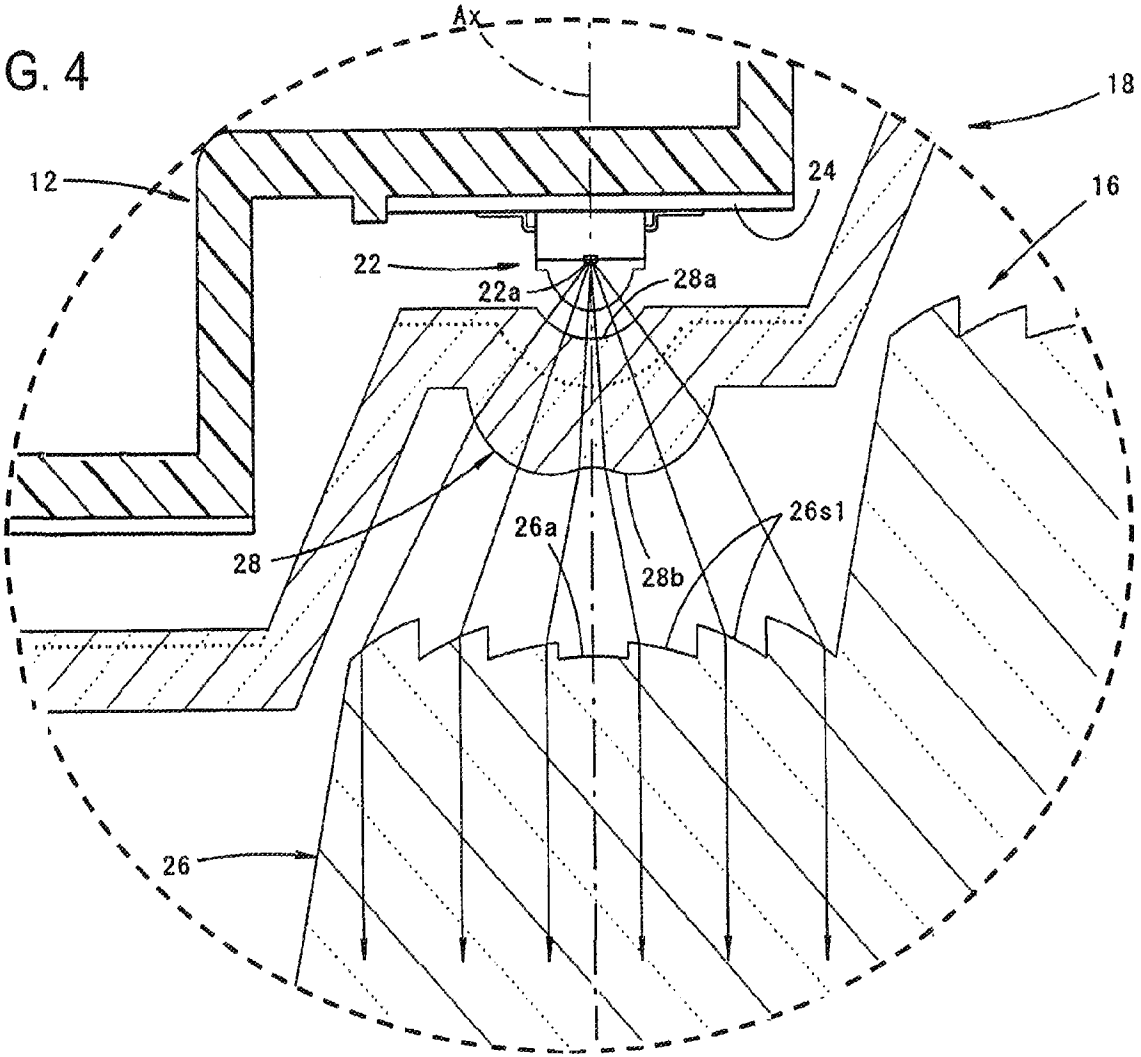
FIG. 4 is a detailed view of the portion 4 in FIG. 1.

FIG. 1 is a horizontally cross-sectional view of a vehicular lamp 10 according to the present embodiment. FIG. 2 is a cross-sectional view taken along the line II-II in FIG. 1, FIG. 3 is a cross-sectional view taken along the line III-III in FIG. 1, and FIG. 4 is a detailed view of the portion 4 in FIG. 1.

As shown in these figures, the vehicular lamp 10 is a front turn signal lamp mounted at the left front end of a vehicle, and it is constructed by incorporating three light-emitting elements 22, a single light guiding plate unit 16, and a single lens member unit 18 in a lamp chamber formed by a lamp body 12 and a generally plain translucent cover 14 attached to the front end opening of the lamp body 12.

The translucent cover 14 is formed to extend toward the rear side of the lamp (i.e., the rear side of the vehicle) from the right end toward the left end (in FIG. 1, from the left end toward the right end) of the translucent cover 14.

The three light-emitting elements 22 are amber light-emitting diodes, and they are provided so that their light-emitting surfaces 22*a* face the forward direction of the lamp (i.e., the forward direction to the front of the vehicle). These three light-emitting elements 22 are provided at substantially regular intervals in the lateral direction (i.e., the vehicle width direction) on the same horizontal plane and offset from each other so that the light-emitting element 22 located closer to the left side (right side in FIG. 1) is disposed closer to the rear Side of the lamp. These light-emitting elements 22 are fixedly supported by substrates 24, respectively, and each of the substrates 24 is fixedly supported by the lamp body 12.

The light guiding plate unit 16 is provided on the front side of the lamp with respect to the three light-emitting elements 22. The front end surface 16*b* of the light guiding plate unit 16 is formed to extend toward the rear side of the lamp from the right end to the left end of the front end surface 16*b* so as to correspond to the wrap-around shape of the translucent cover 14. This light guiding plate unit 16 is fixedly supported at both left and right ends thereof by the lamp body 12.

The light guiding plate unit 16 is constructed as a single member comprising three light guiding plates 26 coupled together. The three light guiding plates 26 are provided at positions corresponding to the three light-emitting elements 22, respectively.

On the other hand, the lens member unit 18 is provided between the three light-emitting elements 22 and the light guiding plate unit 16. This lens member unit 18 is fixedly supported at both left and right sides thereof by the lamp body 12.

The lens member unit 18 is constructed as a single member comprising three lens members 28 coupled together, and these three lens members 28 are provided at positions corresponding to the three light-emitting elements 22, respectively.

In the shown embodiment as described above, light emitted from each light-emitting element 22 and deflected and transmitted through each lens member 28 of the lens member unit 18 is incident on each light guiding plate 26 of the light guiding plate unit 16 from the rear end surface 26*a* of each light guiding plate 26, and then the light is emitted out from the front end surface 26*b* of each light guiding plate 26 to the front of the lamp.

Thus, the vehicular lamp 10 according to the shown embodiment is constructed to include three sets of the light-emitting element 22, the light guiding plate 26, and the lens member 28 that are provided on an optical axis Ax that extends in the longitudinal (front-rear) direction of the lamp. These three optical systems have similar configurations except that the degree of inclination of the front end surface 26*b* in the lateral direction slightly varies among the light guiding plates 26 according to the wrap-around shape of the front end surface 16*b* of the light guiding plate unit 16 in the lateral direction.

The configuration of one of the optical systems will be described in detail below.

As shown in FIG. 2, the cross-sectional shape of the lens member 28 along a vertical plane including the optical axis Ax is set to a plano-convex aspheric lens shape. In other words, the rear surface 28*a* of the lens member 28 is set to be a convex curve shape, and the front surface 28*b* of the lens member 28 is set to be a linear shape. The rear surface 28*a* of this lens member 28 is constructed as a toric lens surface having as its central axis a vertical line passing through the center of light emission of the light-emitting element 22. As shown in FIG. 4, the cross-sectional shape of the front surface 28*b* of the lens member 28 along a horizontal plane is formed by a concave curve in an area in the proximity of the optical axis Ax, and it is also formed by a convex curve in each of the areas located on both left and right sides of the concave-curve area, and each of the convex curves smoothly connects to the concave curve.

With the above structure, the lens member 28 allows a part of emitted light from the light-emitting element 22, which travels in the direction close to the optical axis Ax, to reach the light guiding plate 26 as diffusing light that diffuses in a horizontal plane and further allows the emitted light from the light-emitting element 22 to reach the light guiding plate 26 as parallel light along the optical axis Ax in a vertical plane.

Figure 5:
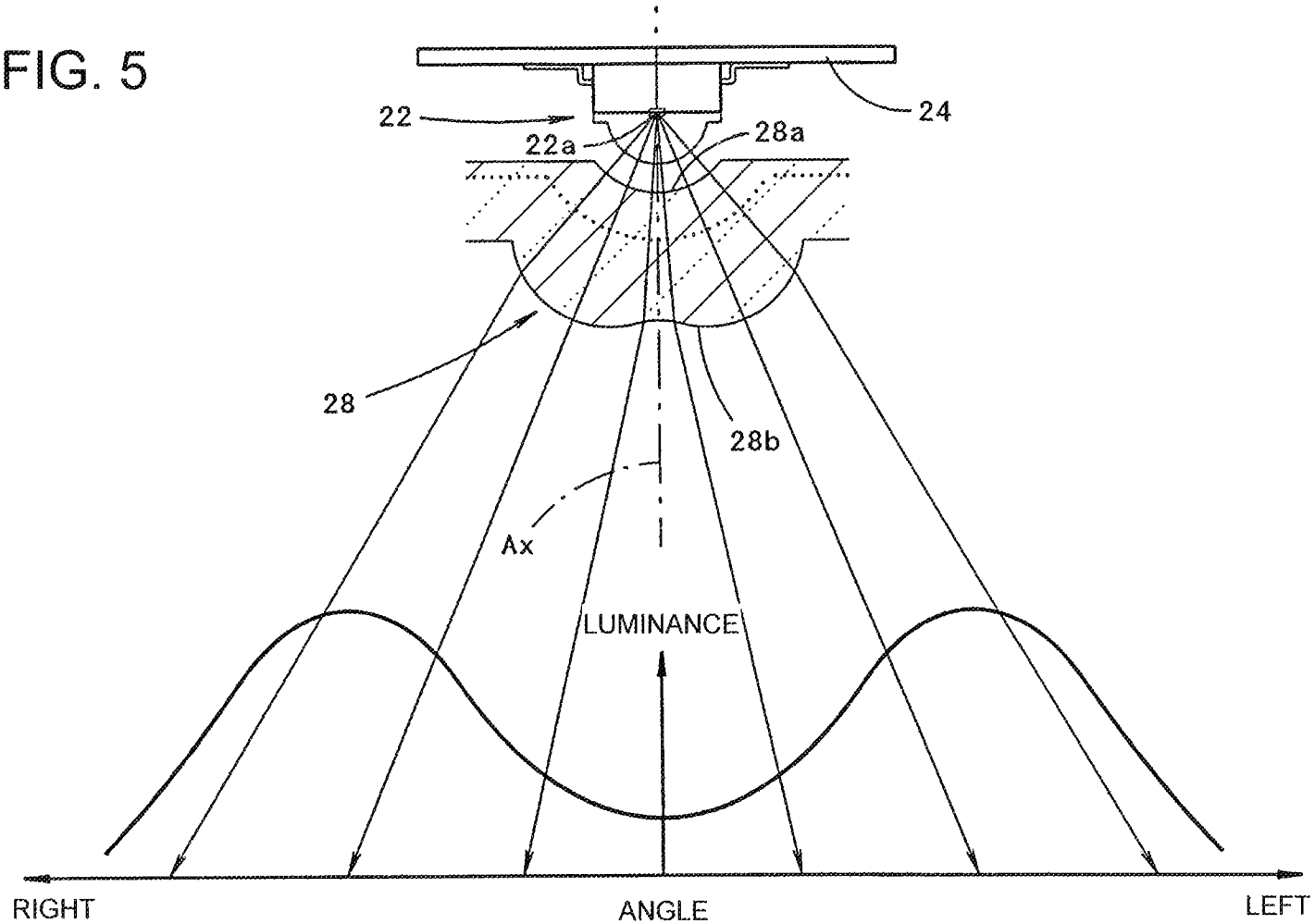
FIG. 5 illustrates the operations of a lens member of the vehicular lamp of the present invention.

Furthermore, as shown in FIG. 5, the cross-sectional shape of the front surface 28*b* of the lens member 28 along the horizontal plane is set so as to allow the emitted light from the light-emitting element 22 to reach the light guiding plate 26 in a luminance distribution that a pair of luminance peak values appear on both left and right sides of the optical axis Ax in the horizontal plane.

A Fresnel lens having a vertical ridge and groove pattern is, as best seen in FIG. 4, formed as a lens component 26*s*1 on the rear end surface 26*a* of the light guiding plate 26. This allows the emitted light from the light-emitting element 22, which has reached the light gliding plate 26 through the lens member 28, to be incident on the light guiding plate 26 as light parallel to the optical axis Ax in the horizontal plane.

As shown in FIG. 1, a plurality of diffusion lens elements 26*s*2 are formed on the front end surface 26*b* of the light guiding plate 26. The plurality of diffusion lens elements 26*s*2 are provided in two rows, namely upper and lower rows as best seen in FIG. 2, and each diffusion lens element 26*s*2 is formed as a fisheye lens. As a result, the light that has reached the front end surface 26*b* of the light guiding plate 26 is emitted to the front of the lamp as light that diffuses in the vertical and lateral directions about the optical axis Ax.

Figure 6A:
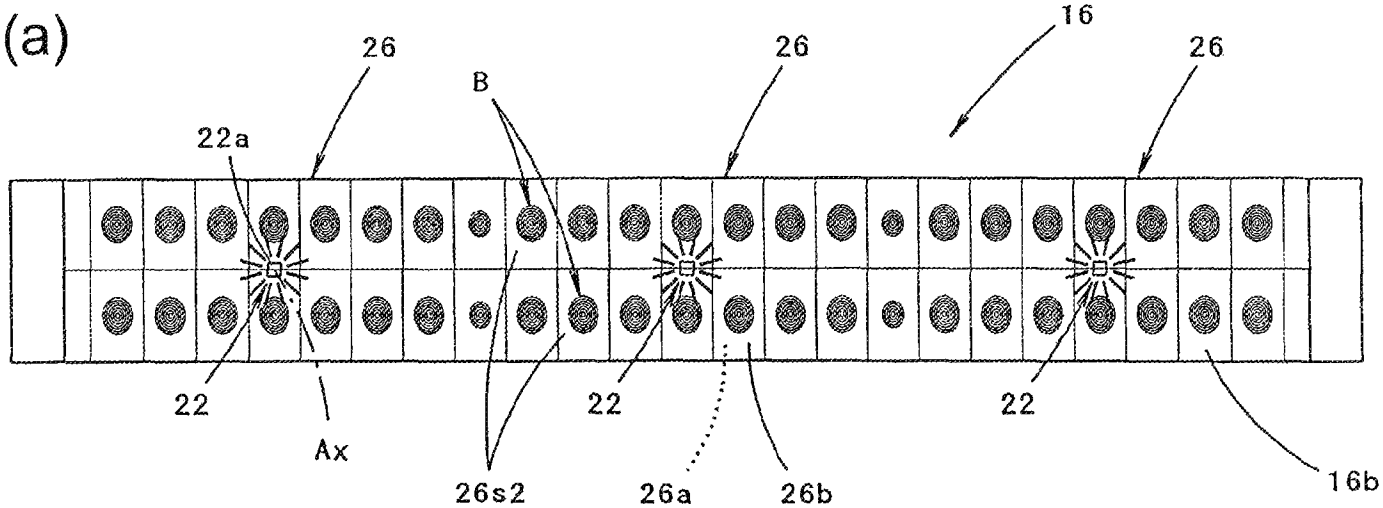
FIG. 6(*a*) is a front view of a light guiding plate unit when each light-emitting element of the vehicular lamp is lit, and FIG. 6(*b*) is a view similar to FIG. 6(*a*) and shows the operations of a conventional lamp.
Figure 6B:
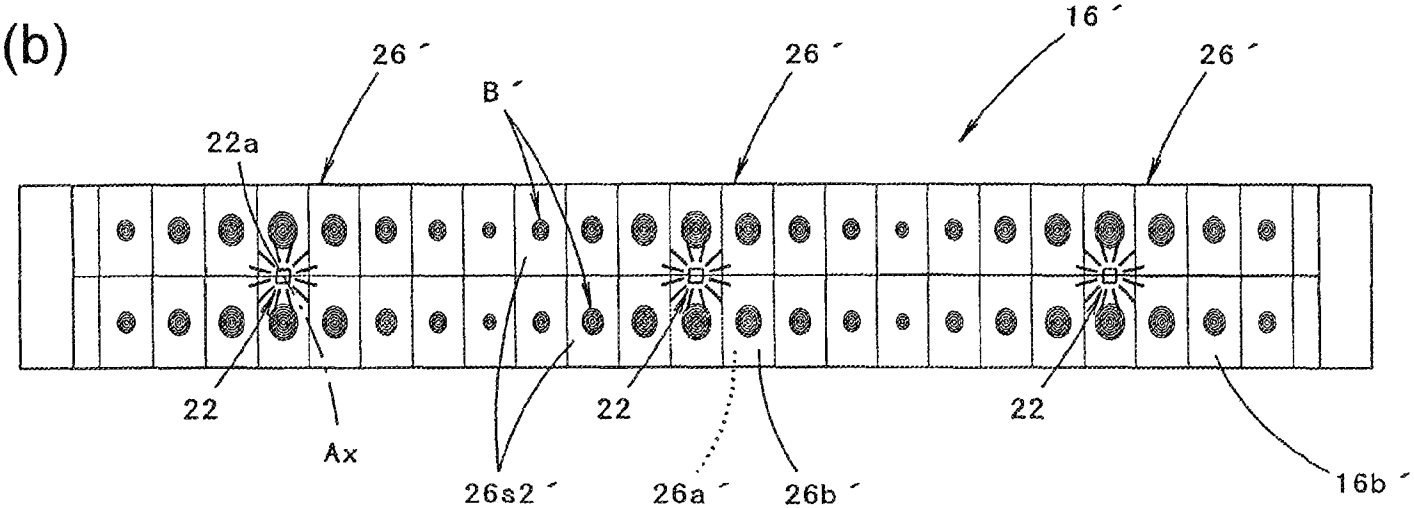

FIG. 6(*a*) is a front view showing how the light guiding plate unit 16 appears when each light-emitting element 22 is lit in the vehicular lamp 10 according to the shown embodiment. FIG. 6 is a front view showing, as in the conventional example, how the light guiding plate unit 16' appears when each light-emitting element 22 is lit in the case where no lens member unit 18 is provided in the configuration of the vehicular lamp 10 of the shown embodiment.

The light guiding plate unit 16' shown in FIG. 6(*b*) is similar to the light guiding plate unit 16 of the shown embodiment of the present invention in the shape of the front end surface 16*b*'; however, the rear end surface of the light guiding plate unit 16' is constructed so that the rear end surface 26*a*' of each light guiding plate 26' allows the emitted light from the light-emitting element 22 to be incident on the light guiding plate 26 as light parallel to the optical axis Ax.

As shown in FIG. 6(*a*), in the light guiding plate unit 16 of the shown embodiment, each of the respective central portions of the plurality of diffusion lens elements 26*s*2 formed on the front end surface 26*b* of each light guiding plate 26 appears to be lit as a bright portion B, and in this case, all of the plurality of diffusion lens elements 26*s*2 of each light guiding plate 26 appear to be brightly lit in a substantially uniform manner.

On the other hand, as shown in FIG. 6(*b*), in the light guiding plate unit 16' as well, each of the respective central portions of a plurality of diffusion lens elements 26*s*2' formed on a front end surface 26*b*' of each light guiding plate 26' appears to be lit as a bright portion B': However, the light guiding plate unit 16' is generally darker than the light guiding plate unit 16 of the shown embodiment, and though the area close to the optical axis Ax in each light guiding plate 26' is relatively bright, each light guiding plate 26' becomes rapidly dark as the distance from the optical axis Ax increases to the left and right sides. This is because, the light guiding plate unit 16', the emitted light from each light-emitting element 22 that reaches the rear end surface 26*a*' of each light guiding plate 26' has such an intensity distribution that the light intensity rapidly decreases as the distance from the optical axis Ax increases to the left and right sides, and the amount of emitted light from each light-emitting element 22 that reaches the rear end surface 26*a*' of each light guiding plate 26' is small.

Effects Of the shown embodiment of the present invention will be described below.

The vehicular lamp 10 according to the shown embodiment is constructed so that the emitted light from the light-emitting element 22 is incident on the rear end surface 26*a* of the light guiding plate 26 and then is emitted out from the front end surface 26*b* of the light guiding plate 26 to the front of the lamp, and in this structure, the lens member 28 is provided between the light-emitting element 22 and the light guiding plate 26, and the lens member 28 allows a part of the emitted light from the light-emitting element 22, which travels in a direction close to the optical axis Ax (i.e., a direction close to the forward direction of the light-emitting element 22), to reach the light guiding plate 26 as diffusing light that diffuses in a horizontal plane (i.e., in a first plane along the light guiding plate 26), and further allows the emitted light from the light-emitting element 22 to reach the light guiding plate 26 as parallel light along the optical axis Ax (i.e., as converging light that converges in the forward direction of the light-emitting element 22) in a vertical plane (i.e., in a second plane orthogonal to the first plane). Accordingly, the following effects can be obtained.

Since the lens member 28 allows a part of the emitted light from the light-emitting element 22, which travels in the direction close to the optical axis Ax, to reach the light guiding plate 26 as diffusing light that diffuses in the horizontal plane, the light that reaches the light guiding plate 26 is prevented from having such an intensity distribution that the light intensity becomes extremely high in the forward direction of the light-emitting element 22 in the horizontal plane. Accordingly, the light guiding plate 26 appears to be lit in a substantially uniform manner in the horizontal direction when the light guiding plate 26 is observed from the front of the lamp.

Moreover, the lens member 28 allows the emitted light from the light-emitting element 22 to reach the light guiding plate 26 as parallel light along the optical axis Ax in the vertical plane. Accordingly, the emitted light from the light-emitting element 22 can be efficiently incident on the light guiding plate 26, and thus the light guiding plate 26 appears to be brightly lit when the light guiding plate 26 is observed from the front of the lamp.

As seen from the above, according to the shown embodiment of the present invention, the light guiding plate 26 in the vehicular lamp 10 is allowed to appear to be brightly lit in a substantially uniform manner, and this can improve the appearance of the lamp.

Furthermore, in the shown embodiment, the lens member 28 causes the emitted light from the light-emitting element 22 to reach the light guiding plate 26 in a luminance distribution that a pair of luminance peak values appear on both left and right sides of the optical axis Ax in the horizontal plane. Accordingly, the light that reaches the light guiding plate 26 has a more uniform luminance intensity distribution in the horizontal plane, thus allowing the light guiding plate 26 to appear to be more uniformly lit in the horizontal direction when the light guiding plate 26 is observed from the front of the lamp.

Moreover, in the shown embodiment, the lens component **26*s*1 is formed on the rear end surface 26*a* of the light guiding plate 26, and the lens component 26*s*1 allows the emitted light: from the light-emitting element 22, which has reached the light guiding plate 26 through the lens member 28, to be incident on the light guiding plate 26 as parallel light along the optical axis Ax (i.e., as converging light that converges in the forward direction of the light-emitting element 22) in the horizontal plane. Accordingly, the light guiding plate 26 can be easily made to appear to be brightly lit in a substantially uniform manner in the horizontal direction when the light guiding plate 26** is observed from the front of the lamp.

In the shown embodiment, the light-emitting element 22 is provided at three positions in the horizontal plane, and each of the lens member 28 and the light guiding plate 26 is provided at three positions corresponding to the three light-emitting elements 22. Furthermore, the three lens members 28 are coupled together to form the single lens member unit 18, and the three light guiding plates 26 are coupled together to form the single light guiding plate unit 16. Accordingly, the light guiding plates 26 provided at the three positions appear to be brightly lit in a substantially uniform manner in the horizontal direction when the light guiding plate unit 16 is observed from the front of the lamp, and this can be implemented with a smaller number of parts.

In the description of the above embodiment, the lens component **26*s*1 formed on the rear end surface 26*a* of the light guiding plate 26 is a Fresnel lens having a vertical ridge and groove pattern. However, the lens component 26*s*1** can be formed by a cylindrical lens extending in the vertical direction, etc.

In the description of the above embodiment, each of the light-emitting element 22, the light guiding plate 26, and the lens member 28 is provided at three positions. However, it should be understood that each of the light-emitting element 22, the light guiding plate 26, and the lens member 28 can be placed at two or less positions or at four or more positions.

In the description of the above embodiment, the vehicular lamp 10 is a front turn signal lamp mounted at the left front end of the vehicle. However, even if the vehicular lamp 10 is a front turn signal lamp mounted at the right front end of the vehicle or is a lamp other than the front turn signal lamp, such as, e.g., a tail lamp, effects similar to those of the above embodiment can be obtained by using a configuration similar to that of the above embodiment.

A modification of the above embodiment will be described below.

Figure 7:
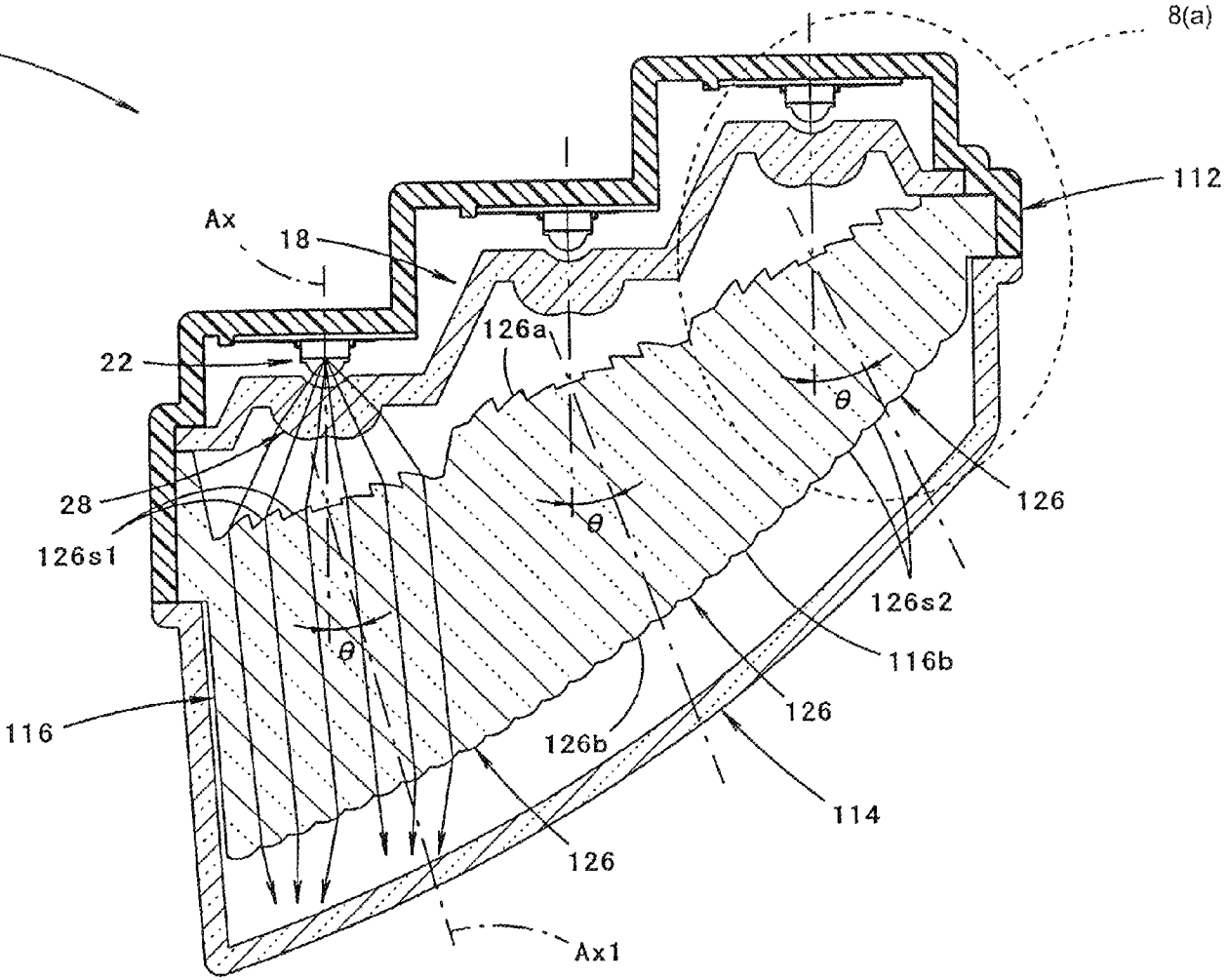
FIG. 7 is a view similar to FIG. 1 showing a modification of the embodiment of the present invention.

FIG. 7 is a view similar to FIG. 1, and it shows a vehicular lamp 110 according to the modification of the above-described embodiment.

As shown in FIG. 7, the vehicular lamp 110 according to this modification is similar to the above-described embodiment in terms of the basic configuration, but is partially different therefrom in the configurations of the lamp body 112, the translucent cover 114, and the light guiding plate unit 116.

More specifically, the translucent cover 114 of the modification is formed to extend for a larger extent toward the rear side of the lamp than the translucent cover 14 of the above-described embodiment. Accordingly, the lamp body 112 of the modification is slightly different from the lamp body 12 of the above-described embodiment in the shape of the front end opening of the lamp body 112.

The light guiding plate unit 116 of the modification is formed so that a front end surface **116*b* thereof extends to a large extent toward the rear side of the lamp from the right end to the left end thereof so as to correspond to the wrap-around shape of the translucent cover 114**.

The light guiding plate unit 116 is formed so that the rear end surfaces **126*a* of the light guiding plates 126 provided at three positions face a direction inclined to the left side With respect to the forward direction of the lamp. In other words, in this modification as well, though a Fresnel lens having a vertical ridge and groove pattern is formed as a lens component 126*s*1 on the rear end surface 126*a* of each light guiding plate 126, its reference axis Ax1 s inclined to the left side with respect to the optical axis Ax. In this case, the inclination angle θ at which each reference axis Ax1 is inclined to the left Side with respect to the optical axis Ax is set to be gradually increased in the order of the light guiding plate 126 located on the right side, the light guiding plate 126 located in the middle, and the light guiding plate 126** located on the left side.

Figure 8:
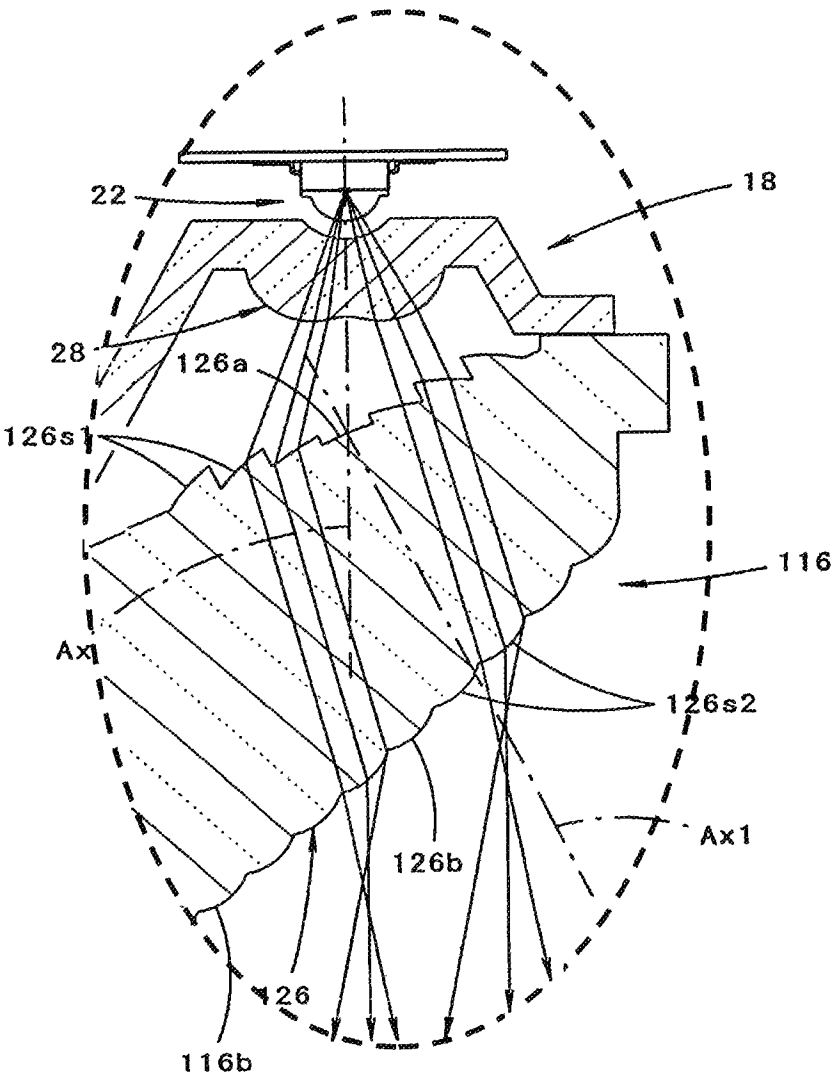
FIG. 8(*a*) is a detailed view of a portion 8(*a*) in FIG. 7, and FIG. 8(*b*) is a view similar to FIG. 8(*a*) and shows a comparative example.
Figure 8:
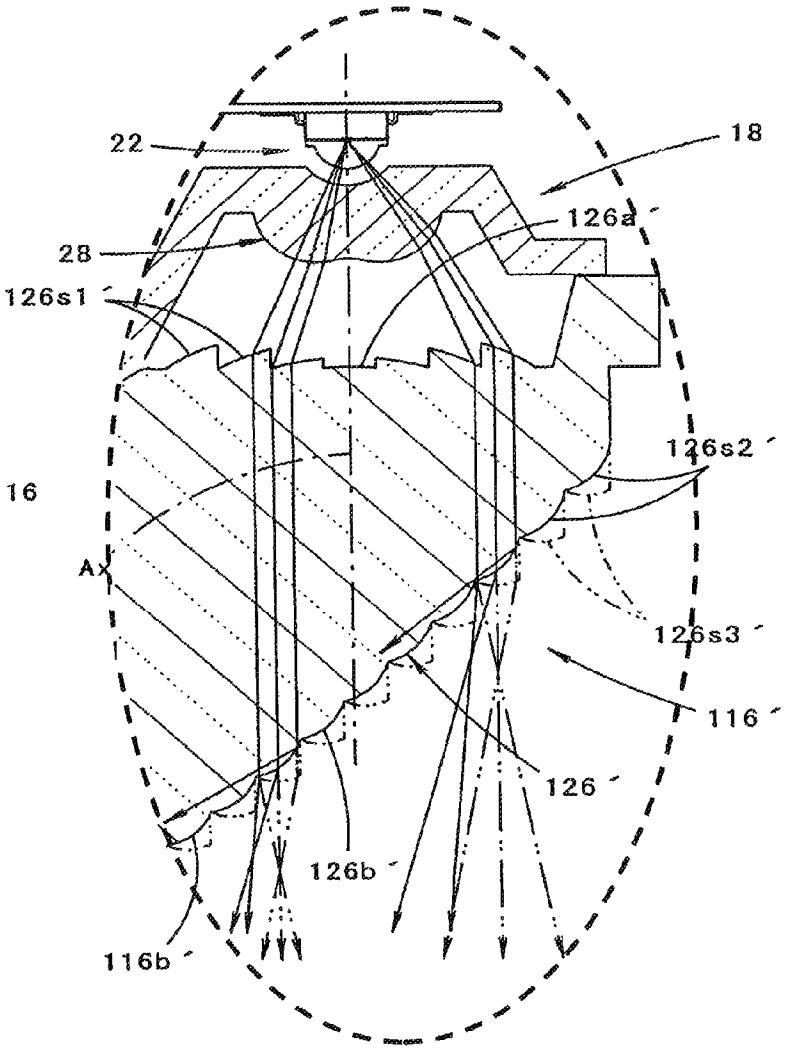

FIG. 8(*a*) is a detailed view of the portion 8(*a*) in FIG. 7. FIG. 8(*b*) is a view similar to FIG. 8(*a*), and it shows a comparative example.

The light guiding plate unit 116' shown in FIG. 8(*b*) is similar to the light guiding plate unit 116 of the modification of FIG. 7 in terms of the shape of the front end surface **116*b*' of the light guiding plate unit 116'. However, regarding the rear end surface 126***a*' of each light guiding plate 126' of the light guiding plate unit 116' faces the forward direction of the lamp, as in the light guiding plate unit 16 of the above-described embodiment.

As shown in FIG. 8(*a*), in the light guiding plate unit 116 of this modification, the rear end surface 126*a* of each light gliding plate 126 faces the direction inclined to the left side. Accordingly, the emitted light from each light guiding plate 126 is emitted as diffusing light that diffuses in a balanced manner to both left and right sides with respect to the forward direction of the lamp, even though a plurality of lens elements 126*s*2 are continuously formed on the front end surface 126*b* of each light guiding plate 126 along the wrap-around shape of the front end surface 126*b*.

On the other hand, as shown in FIG. 8(*b*), in the light guiding plate unit 116' of the comparative example, the rear end surface 126*a*' of each light guiding plate 126' faces the forward direction of the lamp, and a plurality of lens elements 126*s*2' are continuously formed on the front end surface 126*b*' of each light guiding plate 126' along the wrap-around shape of the front end surface 126*b*'. Accordingly, the emitted light from each light guiding plate 126? diffuses in a direction toward the right side with respect to the forward direction of the lamp, and apart of the light that has reached the front end surface 126*b*' of each light guiding plate 126' is totally reflected by the lens elements 126*s*2'. Thus, the emitted light from each light guiding plate 126' cannot be emitted as diffusing light that diffuses in a balanced manner to both left and right sides with respect to the forward direction of the lamp, causing loss of the amount of the emitted light.

In this case, as shown by two-dotted broken lines in FIG. 8(*b*), if a plurality of lens elements 126*s*3' facing the forward direction of the lamp are formed in a staircase pattern on the front end surface 126*b*' of each light guiding plate 126', the emitted light from each light guiding plate 126' can be diffused in a balanced manner to both left and right sides with respect to the forward direction of the lamp, and also loss of the amount of emitted light can be eliminated. However, this configuration may degrade the appearance of the light guiding plate unit 116' due to the large steps formed between the plurality of lens elements 126*s*3'.

On the other hand, by using the configuration of the modification of FIG. 7, effects similar to those of the above-described embodiment can be obtained without degrading the appearance of the light guiding plate unit 116, even if the front end surface 116*b* of the light guiding plate unit 116 is formed to extend to a large extent toward the rear side of the lamp from the right end to the left end thereof.

In particular, in the light guiding plate unit 116 of the modification, the inclination angle θ at which the reference axis Ax1 of the rear end surface 126*a* of each light guiding plate 126 is inclined to the left side with respect to the optical axis Ax is set to gradually increase in the order of the right side, the middle, and the left side, according to the degree of wrap-around of the front end surface 116*b*. Accordingly, the emitted light from each light, guiding plate 126 diffuses in a more balanced manner to both left and right sides with respect to the forward direction of the lamp, even though the plurality of lens elements 126*s*2 are continuously formed on the front end surface 126*b* of each light guiding plate 126.

It should be understood that the numerical values shown as specification in the above embodiment and the modification are by way of example only, and can be set to be appropriate different values.

The invention claimed is:

1. A vehicular lamp comprising:

a plurality of light-emitting elements provided at a plurality of positions in a first plane;

a plurality of light guiding plates provided at positions corresponding to the light-emitting elements such that emitted light from the light-emitting elements is incident on rear end surfaces of the light guiding plates, and then is emitted from front end surfaces of the light guiding plates to a front of the lamp; and a plurality of lens members provided at positions between the light-emitting elements and the light guiding plates, the lens members allowing a part of the emitted light from the light-emitting elements, which travels in a direction close to a forward direction of the light-emitting elements, to reach the light guiding plates as diffusing light that diffuses in the first plane that is along the light guiding plates and further allowing the emitted light from the light-emitting elements to reach the light guiding plates as converging light that converges in the forward direction of the light-emitting elements in a second plane that is orthogonal to the first plane, wherein the plurality of lens members are coupled together to form a single lens member unit.

2. The vehicular lamp according to claim 1, wherein the lens members allow the emitted light from the light-emitting elements to reach the light guiding plates in a luminance distribution that a pair of peak luminance values appear on both sides of the forward direction of each of the light-emitting elements in the first plane.

3. The vehicular lamp according to claim 1, wherein lens components are provided on the rear end surfaces of the light guiding plates so that the lens components allow the emitted light from the light-emitting elements, which has reached the light guiding plates through the lens members, to be incident on the light guiding plates as converging light that converges in the first plane.

4. The vehicular lamp according to claim 1, wherein the front end surfaces of the light guiding plate extend toward a rear side of the lamp from one end to the other end in the first plane, and the rear end surfaces of the light guiding plate faces plates face a direction inclined toward an other end with respect to a forward direction of the lamp.

5. The vehicular lamp according to claim, 1, wherein the plurality of light guiding plates are coupled together to form a single light guiding plate unit.

6. A vehicular lamp comprising:

a plurality of light-emitting elements provided at a plurality of positions in a horizontal plane, a plurality of light guiding plates provided at positions corresponding to the light-emitting elements into which emitted light from the light-emitting elements is incident on rear end surfaces thereof and emitted out from front end surfaces thereof to a front of the lamp, and a plurality of lens members provided at positions between the light-emitting elements and the light guiding plates, wherein a cross-sectional shape of each of the lens members along a vertical plane including an optical axis of a corresponding light-emitting element is a plano-convex aspheric lens shape in which the rear surfaces of the lens members have a convex curve shape and the front surfaces of the lens members have a linear shape, and the plurality of lens members are coupled together to form a single lens member unit.

7. The vehicular lamp according to claim 6, wherein a cross-sectional shape of the front surface of each of the lens members along the horizontal plane takes a concave curve in an area near the optical axis of the corresponding light-emitting element and a convex curve in each of areas on both horizontal sides of the concave-curve area with each of the convex curves smoothly connecting to the concave curve.

8. The vehicular lamp according to claim 6, wherein the plurality of light guiding plates are coupled together to form a single light guiding plate unit.

* * * * *